US008056484B2

(12) United States Patent
Brundisch et al.

(10) Patent No.: US 8,056,484 B2
(45) Date of Patent: Nov. 15, 2011

(54) VEHICLE WITH ANTI-ROLL DEVICES

(75) Inventors: Volker Brundisch, Netphen (DE); Alfred Lohmann, Siegen-Eisern (DE)

(73) Assignee: Bombardier Transportation GmbH, Berlin (DE)

( * ) Notice: Subject to any disclaimer, the term of this patent is extended or adjusted under 35 U.S.C. 154(b) by 31 days.

(21) Appl. No.: 12/063,818

(22) PCT Filed: Aug. 10, 2006

(86) PCT No.: PCT/EP2006/065220
§ 371 (c)(1),
(2), (4) Date: Feb. 14, 2008

(87) PCT Pub. No.: WO2007/020229
PCT Pub. Date: Feb. 22, 2007

(65) Prior Publication Data

US 2009/0260537 A1 Oct. 22, 2009

(30) Foreign Application Priority Data

Aug. 16, 2005 (DE) ..... 10 2005 038 945
Aug. 30, 2005 (DE) ..... 10 2005 041 163

(51) Int. Cl.
*B61F 5/00* (2006.01)

(52) U.S. Cl. ..... 105/199.2

(58) Field of Classification Search ..... 105/3, 4.1, 105/4.4, 164, 176, 199.1, 199.2; 280/124.106
See application file for complete search history.

(56) References Cited

U.S. PATENT DOCUMENTS

| | | | | |
|---|---|---|---|---|
| 1,110,394 | A * | 9/1914 | Lindall | 105/3 |
| 2,081,007 | A * | 5/1937 | Geissen | 105/176 |
| 4,287,832 | A | 9/1981 | Kreissig et al. | |
| 4,324,187 | A | 4/1982 | Sambo | |
| 4,362,109 | A * | 12/1982 | Panagin | 105/182.1 |
| 5,197,392 | A * | 3/1993 | Jeunehomme | 105/3 |
| 5,784,967 | A * | 7/1998 | Lohr | 105/3 |
| 6,167,814 | B1 * | 1/2001 | Sugimoto et al. | 105/3 |

FOREIGN PATENT DOCUMENTS

| | | |
|---|---|---|
| DE | 28 39 904 A1 | 3/1980 |
| DE | 43 11 521 C1 | 4/1994 |
| DE | 198 19 412 C1 | 7/1999 |
| EP | 1 075 407 B1 | 10/2001 |

* cited by examiner

*Primary Examiner* — Joe Morano, IV
*Assistant Examiner* — Zachary Kuhfuss
(74) *Attorney, Agent, or Firm* — The Webb Law Firm

(57) ABSTRACT

A vehicle, in particular a rail vehicle, having a longitudinal axis, at least one first vehicle component which is supported via at least one first spring device on at least one first wheel unit and at least one second spring device on at least one second wheel unit, and having at least one first anti-roll device and a second anti-roll device which are coupled to one another via a coupling device, are each connected to the first vehicle component and counteract rolling motions of the first vehicle component. The first anti-roll device and the second anti-roll device are articulated to the coupling device at first and second articulation points, respectively. The coupling device is configured such that, caused by a counterforce-free first displacement of the first anti-roll device via the first and second articulation points, an opposing second displacement is introduced into the second anti-roll device.

17 Claims, 3 Drawing Sheets

VEHICLE WITH ANTI-ROLL DEVICES

BACKGROUND OF THE INVENTION

1. Field of the Invention

The present invention relates to a vehicle, in particular a rail vehicle, comprising a vehicle longitudinal axis, at least one first vehicle component which is supported via at least one first spring device on at least one first wheel unit and which is supported via at least one second spring device on at least one second wheel unit which is set apart from the first wheel unit in the direction of the vehicle longitudinal axis, and at least one first anti-roll device and a second anti-roll device which are coupled to one another via a coupling device, which are each connected to the first vehicle component and which each counteract rolling motions of the first vehicle component about a roll axis parallel to the vehicle longitudinal axis.

2. Description of the Related Art

In rail vehicles—but also in other vehicles—the body is generally mounted resiliently adverse to the wheel units, for example pairs of wheels or sets of wheels, via one or more levels of suspension. The centrifugal acceleration which occurs when traveling around a bend and acts transversely to the traveling motion and thus transversely to the vehicle longitudinal axis causes, owing to the comparatively high center of gravity of the body, the tendency of the body to bend outward adverse to the wheel units and therefore to perform a rolling motion about a roll axis parallel to the vehicle longitudinal axis.

On the one hand, rolling motions of this type are, above specific limit values, detrimental to driver comfort. On the other hand, they entail the risk of infringement of the admissible clearance profile and unloading of the wheels on one side in a manner which is inadmissible from the point of view of preventing derailing. In order to prevent this, anti-roll devices in the form of what are known as roll stabilizers are used. The purpose of these devices is to resist the rolling motion of the body in order to reduce it without impeding the rising and falling motions of the body relative to the wheel units.

Roll stabilizers of this type are known in various hydraulically or purely mechanically acting embodiments. Use is often made of a torsion shaft which extends transversely to the vehicle longitudinal direction and is known, for example, from EP 1 075 407 B1. Non-rotationally attached levers which extend in the vehicle longitudinal direction are located on this torsion shaft on either side of the vehicle longitudinal axis. These levers are, in turn, connected to links or the like which are arranged kinematically parallel to the spring devices of the vehicle. When the spring devices of the vehicle yield resiliently, the levers located on the torsion shaft are made to rotate via the links connected thereto.

If, when traveling around a bend, a rolling motion occurs with different spring paths of the spring devices on the two sides of the vehicle, this gives rise to different rotational angles of the levers located on the torsion shaft. The torsion shaft is accordingly subjected to a torsional moment which—depending on the torsional stiffness of the shaft—is compensated for at a specific torsional angle by a counter-moment resulting from the elastic deformation of the shaft and thus prevents further rolling motion. In the case of rail vehicles equipped with bogies, the anti-roll device can, on the one hand, be provided for the secondary level of suspension, i.e. act as a first vehicle component between a undercarriage frame and the body. On the other hand, the anti-roll device can also be used in the primary level, i.e. act as a first vehicle component between the wheel units and a undercarriage frame.

Although these isolated roll stabilizers lead to the desired increase in the roll stiffness of the arrangement of the whole, i.e. to a sufficiently low coefficient of inclination of the body, they comprise the drawback that, when traveling on sections of track in which the track plane winds, such as occurs for example in track superelevation ramps or the like, the track planes, which are now inclined toward one another, in the region of the two wheel units cause a high torsional moment to be introduced into the first vehicle component, i.e. the body or the undercarriage frame. This is due to the fact that the respective anti-roll device acts on a setting of the first vehicle component running perpendicularly to the track normal which is in each case provided in the region of the wheel units. As the track normals in the region of the wheel units comprise a differing orientation when the track plane winds, the described torsional loading of the first vehicle component is obtained. In addition to marked stressing of the first vehicle component, the unloading of individual wheels associated therewith can increase the risk of derailing.

In other words, there is a conflict of interests between, on the one hand, a low rolling coefficient or high roll stiffness and, on the other hand, low loading or low torsional stiffness of the first vehicle component and sufficient prevention of derailing of the vehicle.

In order to solve this conflict of interests, a coupling of the individual anti-roll devices is known from DE 28 39 904 C2. In this solution, the anti-roll devices are configured in a hydraulic embodiment. The anti-roll devices each have two working cylinders which act on two sides and the active volumes of which are connected in opposite directions. The anti-roll devices are coupled as a result of the fact that the active volumes of the working cylinders, which are located on one side of the vehicle, of the two anti-roll devices are joined together in the same direction via pipelines.

Apart from the basically undesirable fact that this solution uses a hydraulic installation which is prone to leakage, a significant flow resistance, which substantially reduces the operation and thus the advantage of the arrangement, occurs in the long pipelines between the anti-roll devices at both ends of the carriage.

Similar problems with elevated torsional loads when traveling through sections of track in which the track plane winds also occur in multiple-unit vehicles in which rolling motions between adjacent bodies are prevented via anti-roll devices, in many cases simple transverse links, running transversely to the vehicle longitudinal axis.

SUMMARY OF THE INVENTION

The present invention is therefore based on the object of providing a vehicle of the type mentioned at the outset which does not comprise the above-mentioned drawbacks, or at least comprises them to a lesser degree, and in particular allows torsional loading of the first vehicle component in winding sections of track to be reduced in a simple and reliable manner.

The present invention solves this object, by providing a vehicle, comprising a vehicle longitudinal axis at least one first vehicle component, which is supported via at least one first spring device on at least one first wheel unit, at least one second spring device on at least one second wheel unit, which is set apart from the first wheel unit in the direction of the vehicle longitudinal axis, and at least one first anti-roll device and a second anti-roll device, which are coupled to one another via a coupling device the at least one first anti-roll device and the second anti-roll device are each connected to the first vehicle component and which each counteract rolling motions of the first vehicle component about a roll axis parallel to the vehicle longitudinal axis wherein the first anti-roll device is articulated to the coupling device at a first articulation point, the second anti-roll device is articulated to the coupling device at a second articulation point, and the coupling device is configured in such a way that, caused by a counterforce-free first displacement of the first anti-roll device via the first articulation point and the second articulation point, an opposing second displacement is introduced into the second anti-roll device.

The present invention is based on the technical teaching that reduction of the torsional loading of the first vehicle component in winding sections of track is facilitated in a simple and reliable manner if the first anti-roll device is articulated to the coupling device at a first articulation point, the second anti-roll device is articulated to the coupling device at a second articulation point, and the coupling device is configured in such a way that, caused by a counterforce-free first displacement of the first anti-roll device via the first articulation point and the second articulation point, an opposing second displacement is introduced into the second anti-roll device.

The opposing displacement, achieved in the constraining force-free state, of the two anti-roll devices allows, on the one hand, the above-described advantageous reduction in the torsional loading of the first vehicle component to be achieved. This is due to the fact that the two anti-roll devices may, in the case of a winding or otherwise deformed course of the track plane, even be able, as a result of their opposing displacement achieved owing to the coupling device, completely to follow the deformed course of the track plane without being actuated, i.e. without exerting a restoring force which acts on the first vehicle component and could then lead to the described torsional loading of the first vehicle component.

If, however, such opposing displacement is prevented by a non-deformed course of the track plane, the anti-roll devices can, on the other hand, exercise the full extent of their rolling motion-limiting action. In other words, the effectiveness of the anti-roll devices is not impaired in those cases in which they are actually intended to be used.

A further advantage of the solution according to the invention is that, as the result of the displacement, achieved via the points of articulation to the coupling device, of the anti-roll devices, the design and configuration of the anti-roll devices is not fixed. In the solution according to the invention, any type of anti-roll devices (hydraulic, mechanical, etc.) can thus be used and, if appropriate, combined with one another in any desired manner.

In particularly simply configured variations of the vehicle according to the invention, the coupling device is configured in such a way that a counterforce-free first displacement of the first articulation point brings about an opposing second displacement of the second articulation point. This allows, in particular, the coupling device to be configured in an especially simple manner, as such opposing motion of the two articulation points may, if appropriate, be achieved in a simple manner via a single pivotably mounted lever arm having two free ends, on each of which one of the articulation points is located.

The translation of motion achieved by the coupling device can in principle be selected in any desired form and adapted to the design and configuration of the anti-roll device connected on the respective side of the coupling device. In particularly simply configured variations of the vehicle according to the invention, in particular in variations having identically constructed anti-roll devices, provision is made for the first displacement and the second displacement to comprise substantially the same amount but in differing directions, in particular substantially opposite directions.

Provision is preferably made for the first articulation point to be a bearing point of the first anti-roll device with respect to the first vehicle component and/or for the second articulation point to be a bearing point of the second anti-roll device with respect to the first vehicle component. The displacement of a bearing point of this type of the respective anti-roll device allows the described motion behavior, following the deformed course of the track plane, to be achieved in a particularly simple manner without actuation, generating restoring forces, of the anti-roll devices. In other words, this allows the anti-roll device as a whole to follow the deformed course of the track plane without generating restoring forces.

On account of the simple configuration with opposing motion of the articulation points, provision is preferably made for the coupling device to connect parts of the first anti-roll device and the second anti-roll device that are located on the same side of the vehicle longitudinal axis. Preferably, the coupling device additionally connects components of the first anti-roll device and the second anti-roll device that have the same function and/or position within the respective anti-roll device. Particularly simple design variations having simple kinematics can be achieved in this way.

As mentioned hereinbefore, the coupling device comprises, as a result of the especially simple configuration, preferably at least one first lever arm which is articulated to the first vehicle component so as to be able to pivot about a first pivot point, the first pivot point being arranged in the kinematic chain between the first anti-roll device and the second anti-roll device. Preferably, the first lever arm comprises a free first end and a free second end, the first end being directly connected to the first anti-roll device and the second end being connected to the second anti-roll device directly or via further intermediate elements. This allows, as stated hereinbefore, one of the articulation points to be arranged at each of the free ends of a first lever arm of this type.

In further advantageous variations of the vehicle according to the invention, provision is made for the coupling device to comprise at least one second lever arm which is articulated to the first vehicle component so as to be able to pivot about a second pivot point, the second pivot point being arranged in the kinematic chain between the first anti-roll device and the second anti-roll device, and the second lever arm being connected to the first lever arm via at least one coupling element, in particular a push rod. An arrangement of this type advantageously allows beneficial translations of motion to be achieved, so even relatively large distances can be bridged between the anti-roll devices without the coupling device having to perform large deflections.

As mentioned hereinbefore, the present invention can be used with any desired types of anti-roll devices. Particularly preferred, however, is use thereof in conjunction with the purely mechanical anti-roll devices described at the outset, because this allows particularly robust configurations to be achieved. Preferably, at least one of the anti-roll devices therefore comprises a torsional element connected to the first vehicle component.

The present invention can furthermore be used in conjunction with any desired arrangement variations of anti-roll devices. In advantageous variations of the vehicle according to the invention, the first vehicle component is therefore a undercarriage frame, in particular a bogie frame, the first anti-roll device being connected in that case to the first wheel unit and the second anti-roll device being connected to the second wheel unit.

In further advantageous variations of the vehicle according to the invention, the first vehicle component is a body, the first anti-roll device being connected in that case to the first wheel unit and the second anti-roll device being connected to the second wheel unit.

In further advantageous variations of the vehicle according to the invention, the first vehicle component is, finally, a first body having a first body end and a second body end, a second body, which is adjacent to the first body end, and a third body, which is adjacent to the second body end, being in that case provided, the first anti-roll device being connected to the second body and the second anti-roll device being connected to the third body.

The invention can be used particularly advantageously in conjunction with what are known as wheelless sedans, i.e. bodies which are not provided with wheels and are suspended between two adjacent bodies. Provision is therefore preferably made for the first body to be configured in the manner of a wheelless sedan, said first body being fastened to the second body and the third body.

The coupling device can, as stated hereinbefore, be configured in any desired suitable manner in order to achieve the above-mentioned opposing displacements of the anti-roll devices or on the anti-roll devices. As stated hereinbefore, said coupling device can be configured purely mechanically by a lever transmission or the like. However, it can also be embodied wholly or partially via a fluidic transmission, for example a hydraulic transmission. Further preferred variations of the vehicle according to the invention therefore provide for the coupling device to comprise at least one first working cylinder, in particular a first hydraulic cylinder, which is connected to the first anti-roll device, for the coupling device to comprise at least one second working cylinder, in particular a second hydraulic cylinder, which is connected to the second anti-roll device, and for the coupling device to comprise at least one connecting line, which connects the first working cylinder and the second working cylinder, for a working medium, in particular a hydraulic fluid.

The wheel unit of the vehicle according to the invention can be configured in any desired suitable manner, for example as a undercarriage comprising one or more pairs of wheels or sets of wheels. Preferably, at least one of the wheel units comprises a set of wheels or a pair of wheels.

Further preferred configurations of the invention will emerge from the sub-claims and the following description of preferred exemplary embodiments, which description refers to the appended drawings.

DETAILED DESCRIPTION OF THE PREFERRED EMBODIMENTS

Figure 1:
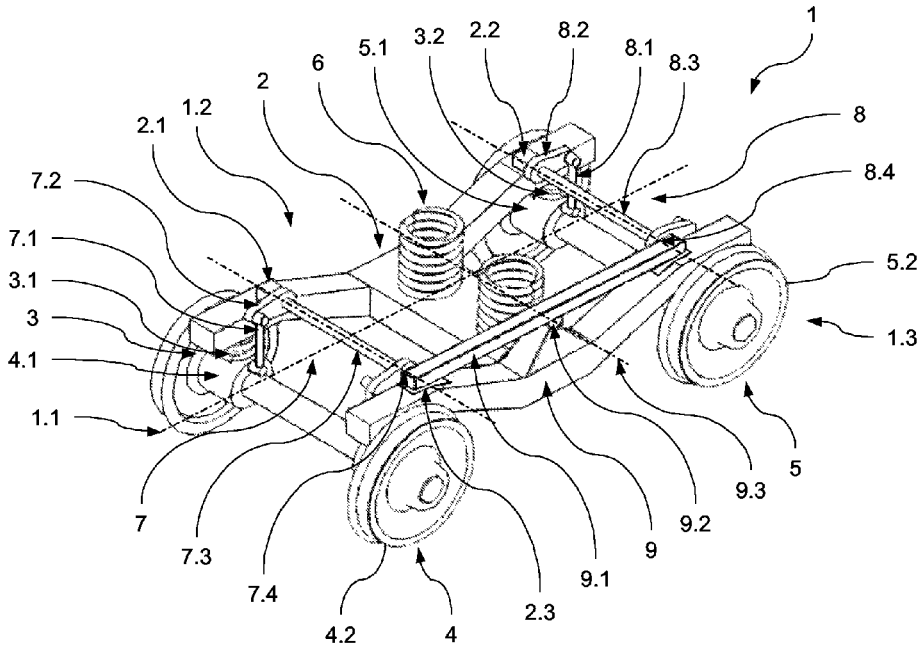
FIG. 1 depicts a schematic perspective view of a part of a preferred embodiment of the vehicle according to the invention in the neutral position.

FIG. 1 is a schematic perspective view of a part of a preferred embodiment of the vehicle 1 according to the invention having a vehicle longitudinal axis 1.1. The vehicle 1 comprises a first vehicle component in the form of a undercarriage frame, in this case a bogie frame 2, which is supported via a primary suspension 3 on two wheel units in the form of sets of wheels 4 and 5. The bogie frame 2, which is configured with angled end regions, extends substantially in a plane of the bogie frame. A body (not shown in FIG. 1) is also supported on the bogie frame 2 via a secondary suspension 6.

The first set of wheels 4 and the second set of wheels 5 are set apart from each other in the direction of the vehicle longitudinal axis 1.1. The bogie frame 2 is supported on the wheel bearings of the first set of wheels 4 via a respective first primary spring device 3.1, whereas it is supported on the wheel bearings of the second set of wheels 5 via a respective second primary spring device 3.2.

In FIG. 1, both the primary spring devices 3.1 and 3.2 and the secondary suspension 6 are shown in simplified form as coil springs. However, it will be understood that they can in fact also have any other desired configuration such as is possible for primary and secondary suspensions of this type.

A respective anti-roll device 7 or 8 is arranged between the respective set of wheels 4, 5 and the bogie frame 2, i.e. in the region in the primary level. A first anti-roll device 7 is thus provided between the first set of wheels 4 and the bogie frame 2, whereas a second anti-roll device 8 is provided between the second set of wheels 5 and the bogie frame 2.

The first anti-roll device 7 comprises on each side of the bogie frame 2, parallel to each first primary spring device 3.1, a rod 7.1 which is articulated, on the one hand, so as to be able to pivot on the respective wheel set bearing 4.1 and, on the other hand, so as to be able respectively to pivot on a lever 7.2 of the first anti-roll device 7. The two levers 7.2 are non-rotationally located on a torsion shaft 7.3 of the first anti-roll device 7. The torsion shaft 7.3 is, on one vehicle longitudinal side 1.2, rotatably mounted in a bearing block 2.1 which is rigidly connected to the bogie frame 2 and forms a bearing point of the first anti-roll device 7 with respect to the first vehicle component 2. On the other vehicle longitudinal side 1.3, the torsion shaft 7.3 is rotatably mounted at a first articulation point 7.4 in a first free end of a first lever arm 9.1 of a coupling device 9, the operation of which will be described in greater detail hereinafter. The first articulation point 7.4 forms in this case a further bearing point of the first anti-roll device 7 with respect to the first vehicle component 2.

Similarly, the second anti-roll device 8 comprises on each side of the bogie frame 2, parallel to each second primary spring device 3.2, a rod 8.1 which is articulated, on the one hand, so as to be able to pivot on the respective wheel set bearing 5.1 and, on the other hand, so as to be able respectively to pivot on a lever 8.2 of the second anti-roll device 8. The two levers 8.2 are, again, non-rotationally located on a rotatably mounted torsion shaft 8.3 of the second anti-roll device 8. The torsion shaft 8.3 is, on one vehicle longitudinal side 1.2, again rotatably mounted in a bearing block 2.2 which is rigidly connected to the bogie frame 2 and forms a bearing point of the second anti-roll device 8 with respect to the first vehicle component 2. On the other vehicle longitudinal side 1.3, the torsion shaft 8.3 is rotatably mounted at a second articulation point 8.4 in the second free end of the first lever arm 9.1 of the coupling device 9, so the first anti-roll device 7 is mechanically coupled to the second anti-roll device 8 via the coupling device 9. The second articulation point 8.4 forms, in this case, a further bearing point of the second anti-roll device 8 with respect to the first vehicle component 2.

The term "a bearing point of the respective anti-roll device 7 or 8 with respect to the first vehicle components 2" refers in the sense of the present invention to a bearing point of the anti-roll device 7 or 8 which is stationary on non-actuation or fixing of the coupling device 9 and on actuation of the anti-roll device 7 or 8 with respect to the first vehicle component, i.e. in the present case the bogie frame 2.

The first lever arm 9.1 is articulated to the bogie frame 2 via a central pivot point 9.2 which is positioned in the kinematic chain centrally between the first articulation point 7.4 and the second articulation point 8.4. The first lever arm 9.1 is in this case pivotable about a pivot axis 9.3 which runs parallel to the vehicle transverse axis and is fixed to the bogie frame 2.

The mode of operation of the coupling device 9 and of the first anti-roll device 7 and second anti-roll device 8 which are coupled via said coupling device will be described hereinafter.

When traveling in an undeformed track bend, the body (not shown in FIG. 1) experiences, as a result of the centrifugal force acting on its center of gravity which is located above the bogie frame 2, a rolling moment about a roll axis parallel to the vehicle longitudinal axis 1.1. This rolling moment results in differingly marked resilient yielding of the secondary suspension 6. If, for example, the vehicle longitudinal side 1.3 is located on the outside of the bend, the part of the secondary suspension 6 yields more markedly on this side than on the other vehicle longitudinal side 1.2. This is also transmitted to the primary suspension 3 via the bogie frame 2. The primary springs 3.1 and 3.2 thus yield more markedly on the bend-exterior vehicle longitudinal side 1.3 than on the bend-interior vehicle longitudinal side 1.2. In the undeformed track bend, the primary springs 3.1 and 3.2 yield to the same extent on the respective vehicle longitudinal side 1.2 or 1.3.

Owing to the differingly marked resilient yielding of the primary springs 3.1 and 3.2 on the two vehicle longitudinal sides 1.3 and 1.2, the levers 7.2 of the first anti-roll device 7 also undergo differingly marked deflections on the two vehicle longitudinal sides 1.3 and 1.2. This results in resilient torsion of the torsion shaft 7.3. The same applies to the levers 8.2 of the second anti-roll device 8 on the two vehicle longitudinal sides 1.3 and 1.2. These also undergo differingly marked deflections, resulting in resilient torsion of the torsion shaft 8.3.

As, in the undeformed track bend, the forces are distributed substantially uniformly along the vehicle longitudinal axis 1.1 and the primary springs 3.1 and 3.2 thus yield to the same extent on each vehicle longitudinal side 1.2 or 1.3, the same vertical forces act on the first articulation point 7.4 and the second articulation point 8.4 perpendicularly to the plane of the bogie frame. As a result, the first lever 9.1 of the coupling device 9 remains, owing to the central arrangement of the pivot point 9.2, substantially in its neutral position which is shown in FIG. 1 and in which it is oriented substantially parallel to the plane of the bogie frame. In other words, in the undeformed track bend, the two anti-roll devices 7 and 8 provide the same effect as the known anti-roll devices in which all of the articulation points are located in bearing blocks secured to the bogie frame.

The described configuration of the coupling device 9 and the articulation of the two anti-roll devices 7 and 8 to the coupling device 9 have, on the other hand, the effect that a counterforce-free first displacement of the anti-roll device 7, with a first deflection of the first articulation point 7.4 downward via the first lever 9.1, causes an opposing second displacement of the second anti-roll device 8 with a second deflection, opposing the first deflection, of the second articulation point 8.4 upward. The amount of the displacements or deflections is in this case identical, whereas the directions are in each case opposite.

Such displacements of the anti-roll devices 7 and 8 produce no significant torsion of the torsion shafts 7.3 and 8.3, so no significant additional forces, which would otherwise deform, in particular twist, the bogie frame 2, are introduced into the bogie frame 2 via the anti-roll devices 7 and 8.

In order to allow displacements of the articulation points 7.4 and 8.4 in the direction of the bogie frame, said bogie frame comprises corresponding recesses 2.3 in the region of the free ends of the first lever 9.1. Furthermore, it will be understood that the mounting of the torsion shafts 7.3 and 8.3 in the bearing blocks 2.1 and 2.2 and in the first lever 9.1 is configured in such a way as readily to allow tilting of the torsion shafts 7.3 and 8.3 relative to the vehicle transverse axis.

If, in the case of the vehicle 1 from FIG. 1, the primary springs 3.1 and 3.2 therefore yield differently, not as a result of rolling of the body but rather as a result of deformation, for example torsion, of the section of track traveled over, i.e. as a result of differing vertical coordinates of the contact points of the wheels of the sets of wheels 4 and 5 on the rails (not shown in FIG. 1), the two anti-roll devices 7 and 8 can, owing to the described configuration of the coupling device 9, if appropriate fully follow the deformed shape of the track as a result of tilting of the first lever 9.1. This may lead, depending on the nature of the deformation of the track bed, to the described displacements of the two anti-roll devices 7 and 8 without torsion of the torsion shafts 7.3 and 8.3.

In specific cases, there is for example torsion of the track as a result of a longitudinal gradient of the rail, which is located on the right-hand vehicle longitudinal side 1.3 (in the direction of travel), when the rail located on the left-hand vehicle longitudinal side 1.2 is in the horizontal position, the two rails comprising the same track level in the center between the two sets of wheels 4 and 5. In this case, the contact point of the wheel 5.2, which is located at the front right in the direction of travel, is higher than that of the wheel pertaining to the same set of wheels 5 on the left-hand vehicle longitudinal side 1.2. Conversely, the contact point of the wheel 4.2, which is located at the rear right in the direction of travel, is lower than that of the wheel pertaining to the same set of wheels 4 on the left-hand vehicle longitudinal side 1.2.

However, the vertical displacements which are transmitted via the respective rods 7.1 and 8.1 from the front and rear wheel 4.2 and 5.2 respectively on the right-hand vehicle longitudinal side 1.3 do not lead to torsion of the torsion shafts 7.3 and 8.3 of the two anti-roll devices 7 and 8. On the contrary, said displacements are compensated for by raising of the second articulation point 8.4 above the right-hand front wheel 5.2 and lowering of the first articulation point 7.4 above the right-hand rear wheel 4.2 via the tilting of the first lever 9.1 about its tilt axis 9.3.

It will be understood that in the event of a differing height of the raising or lowering of the two wheels 4.2 and 5.2, which are arranged on the same vehicle longitudinal side, the bogie frame 2 is raised or lowered, as a result of the residual force produced at the pivot point 9.2 in the region of the pivot point 9.2, by half the differential amount on this vehicle longitudinal side. Reaction forces, such as occur in the bearings, which are rigidly connected to the bogie frame, of known anti-roll devices and which markedly stress the leading and trailing ends of the longitudinal girders of the bogie frame 2, are in this case dispensed with.

The coupling device 9 thus brings about, in the region of the anti-roll devices 7 and 8, advantageous isolation of reactions to rolling motions and reactions to track deformations, in particular track torsion, in that mechanical displacements are carried out at articulation points 7.4 and 8.4 of the anti-roll devices 7 and 8. The achievement of the described compensatory effect as a result of mechanical displacements at articulation points 7.4 and 8.4 of the anti-roll devices 7 and 8 has, in addition to the simple mechanical embodiment, the advantage that the invention can be used with anti-roll devices of any desired configuration without having in any one form substantially to intervene in the configuration of the anti-roll device.

In order to achieve the described isolation of the reactions of the anti-roll devices 7 and 8, a single coupling device 9 has merely to be provided. Nevertheless, it will be understood that, in other variations of the invention, a corresponding coupling device can also be provided on both sides. Furthermore, it will be understood that other variations of the invention can also make provision for a coupling device in which, on displacement of the first anti-roll device on the opposing vehicle longitudinal side, displacement of the second anti-roll device in the same direction is achieved, as overall this allows merely the same compensatory motion to be achieved.

Figure 2:
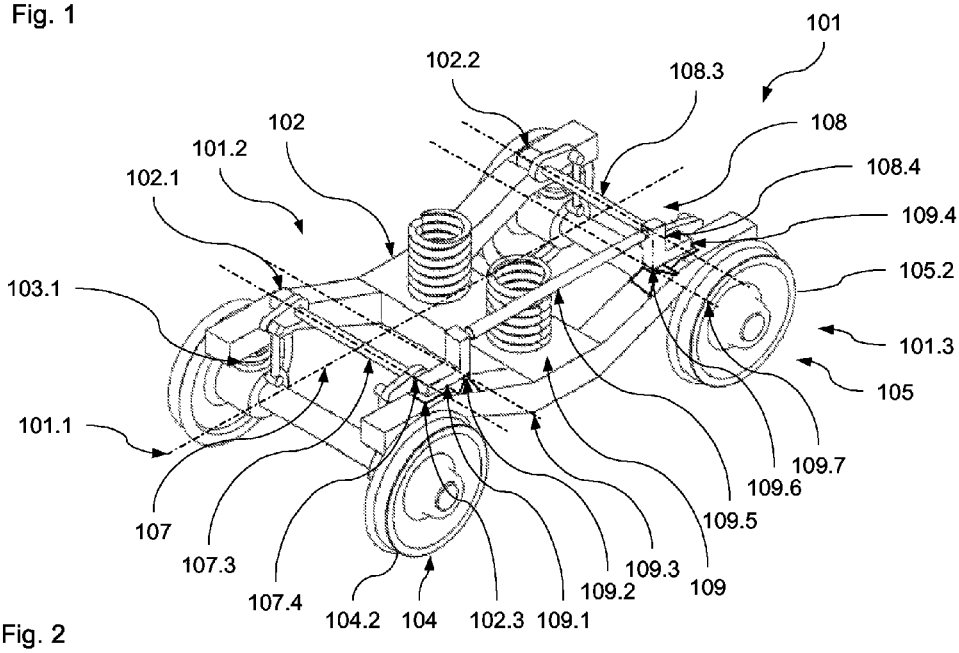
FIG. 2 depicts a schematic perspective view of a part of a further preferred embodiment of the vehicle according to the invention in the neutral position.

A further advantageous embodiment of the vehicle 101 according to the invention is shown in FIG. 2. In its basic configuration and mode of operation, the vehicle 101 corresponds in this case to the vehicle 1 from FIG. 1, so merely the differences will now be examined.

The only difference to the embodiment from FIG. 1 is the configuration of the coupling device 109 via which the two anti-roll devices 107 and 108 are linked together. Instead of the first lever arm 9.1, the coupling device 109 comprises a first lever arm 109.1 and a second lever arm 109.4 which are coupled via a coupling rod 109.5 configured as a push/pull rod.

The first lever arm 109.1, which is configured as a short angle lever, is articulated, in proximity to the first anti-roll device 107, to the bogie frame 102 so as to be able to pivot about a first pivot point 109.2 having a first pivot axis 109.3. The first pivot axis 109.3 is located in the region of the kink in the first lever arm 109.1 and is stationarily connected to the bogie frame 102.

The first articulation point 107.4 of the first anti-roll device 107 is located at the first free end of the first lever arm 109.1, whereas the coupling rod 109.5 is articulated to the second free end of the first lever arm 109.1 via a ball-and-socket joint or a similarly movable joint.

The second lever arm 109.4, which is also configured as a short angle lever, is articulated, in proximity to the second anti-roll device 108, to the bogie frame 102 so as to be able to pivot about a second pivot point 109.6 having a second pivot axis 109.7. The second pivot axis 109.7 is located in the region of the kink in the second lever arm 109.4 and is stationarily connected to the bogie frame 102.

The second articulation point 108.4 of the second anti-roll device 108 is located at the first free end of the second lever arm 109.4, whereas the coupling rod 109.5 is articulated to the second free end of the second lever arm 109.4 via a ball-and-socket joint or a similarly movable joint.

The first articulation point 107.4 and the second articulation point 108.4 form, again, bearing points of the respective anti-roll device 107 or 108 with respect to the first vehicle component 102 in the sense of the present invention, i.e. a bearing point of the anti-roll device 107 or 108 which is stationary on non-actuation or fixing of the coupling device 109 and on actuation of the anti-roll device 107 or 108 with respect to the first vehicle component, i.e. in this case the bogie frame 102.

The first lever arm 109.1 and the second lever arm 109.4 comprise identical dimensions and are arranged symmetrically to the transverse center plane of the bogie frame 102. The coupling rod 109.5 runs in this case continuously on one side of the straight line connecting the pivot points 109.2 and 109.6, so a counterforce-free deflection of the first free end of the first lever arm 109.1 generates an opposing deflection of the first free end of the second lever arm 109.4 and vice versa.

Owing to the position of the first articulation point 107.4 at the first free end of the first lever arm 109.1 and the position of the second articulation point 108.4 at the first free end of the second lever arm 109.4, the coupling device 109, like the coupling device 9 from FIG. 1, causes opposing deflections of the first articulation point 107.4 and the second articulation point 108.4 of each anti-roll device 107 or 108. The amount of the deflections is in this case identical, whereas the directions are opposite in each case.

The displacements resulting therefrom of the anti-roll devices 107 and 108 do not lead to any significant torsion of the torsion shafts 107.3 and 108.3, so no significant additional forces, which would otherwise deform, in particular twist, the bogie frame 102, are introduced into the bogie frame 102 via the anti-roll devices 107 and 108.

When traveling in an undeformed track bend, the body (not shown in FIG. 2) experiences as a result of the centrifugal force, as described hereinbefore, a rolling moment about a roll axis parallel to the vehicle longitudinal axis 101.1.

This rolling moment results in differingly marked resilient yielding of the primary springs 103.1 and 103.2. Said springs yield more markedly on the bend-exterior vehicle longitudinal side 101.3 than on the bend-interior vehicle longitudinal side 101.2.

The primary springs 103.1 and 103.2 yield substantially to the same extent on each vehicle longitudinal side 101.2 or 101.3 in the undeformed track bend owing to the substantially uniform distribution of force. Therefore, the same vertical forces act on the first articulation point 107.4 and the second articulation point 108.4 perpendicularly to the plane of the bogie frame. As a result, the first lever 109.1 and the second lever 109.4 of the coupling device 109 remain, owing to their identical dimensions, substantially in their neutral position shown in FIG. 2. In other words, in the undeformed track bend, the two anti-roll devices 107 and 108 also provide the same effect as the known anti-roll devices in which all of the articulation points are located in bearing blocks secured to the bogie frame.

In order to allow displacements of the articulation points 107.4 and 108.4 in the direction of the bogie frame 102, said bogie frame comprises corresponding recesses 102.3 in the region of the first free end of the first lever 109.1 and in the region of the first free end of the second lever 109.4. Furthermore, it will be understood that the mounting of the torsion shafts 107.3 and 108.3 in the bearing blocks 102.1 and 102.2 and in the first lever 109.1 and the second lever 109.4 is configured in such a way as readily to allow tilting of the torsion shafts 107.3 and 108.3 relative to the vehicle transverse axis.

If, in the case of the vehicle 101 from FIG. 2, the primary springs 3.1 and 3.2 yield differently, not as a result of rolling of the body but rather as a result of deformation, for example torsion, of the section of track traveled over, i.e. as a result of differing vertical coordinates of the contact points of the wheels 104.2 and 105.2 respectively of the sets of wheels 104 and 105 on the rails (not shown in FIG. 2), the two anti-roll devices 107 and 108 can, owing to the described configuration of the coupling device 109, if appropriate fully follow the deformed shape of the track as a result of tilting of the first lever 109.1 and the second lever 109.4. This may lead, depending on the nature of the deformation of the track bed, to the described displacements of the two anti-roll devices 107 and 108 without torsion of the torsion shafts 107.3 and 108.3.

It will be understood that in the event of a differing height of the raising or lowering of the two wheels 104.2 and 105.2, which are arranged on the same vehicle longitudinal side, the bogie frame 102 is centrally raised or lowered, as a result of the residual force produced in the coupling device 109 at the pivot points 109.2 and 109.6, by half the differential amount on this vehicle longitudinal side. Reaction forces, such as occur in the bearings, which are rigidly connected to the bogie frame, of known anti-roll devices and which markedly stress the leading and trailing ends of the longitudinal girders of the bogie frame 102, are in this case dispensed with.

The coupling device 109 thus brings about, in the region of the anti-roll devices 107 and 108, likewise advantageous isolation of reactions to rolling motions and reactions to track deformations, in particular track torsion, in that mechanical displacements are carried out at articulation points 107.4 and 108.4 of the anti-roll devices 107 and 108. The advantages of this isolation have been discussed hereinbefore in relation to FIG. 1, so reference is made in this regard to the foregoing discussion.

Figure 3:
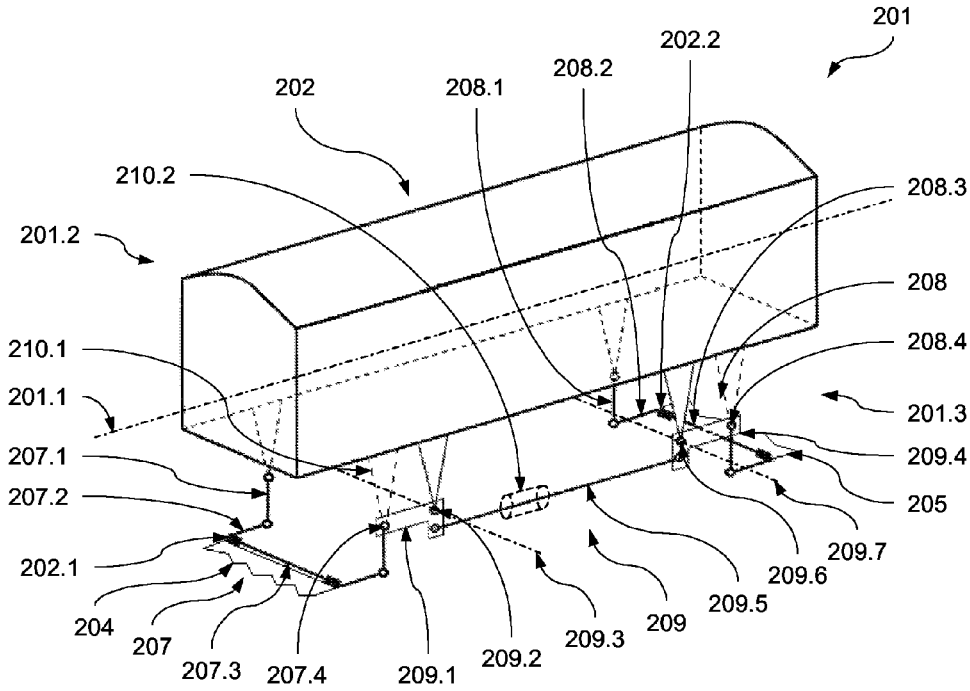
FIG. 3 depicts a schematic perspective view of a part of a further preferred embodiment of the vehicle according to the invention in the neutral position.

A further advantageous embodiment of the vehicle 201 according to the invention with the isolation in the region of the secondary suspension is shown in FIG. 3. FIG. 3 is a schematic perspective view of a part of the vehicle 201 having a vehicle longitudinal axis 201.1. The vehicle 201 comprises a first vehicle component in the form of a body 202 which is respectively supported via a body spring device (not shown), for example a secondary spring device, on two wheel units, in the form of running gears 204 and 205, which are set apart from each other in the direction of the vehicle longitudinal axis 201.1.

It will be understood that the undercarriages 204 and 205 can be undercarriages of any desired configuration. They may, for example, be both single-axle undercarriages and bogies. In the case of single-axle running gears, in particular, the body spring device can then be configured at one level and form the sole suspension of the body.

A respective anti-roll device 207 or 208 is arranged between the respective undercarriage 204, 205 and the body 202, i.e. in the region in the body suspension level, parallel to the body spring devices contained therein. A first anti-roll device 207 is thus provided between the first undercarriage 204 and the body 202, whereas a second anti-roll device 208 is provided between the second undercarriage 205 and the body 202.

The first anti-roll device 207 comprises on each side of the first undercarriage 204, parallel to each body spring device, a rod 207.1 which is pivotably articulated, on the one hand, to a lever 207.2 of the first anti-roll device 207. The two levers 207.2 are non-rotationally located on a torsion shaft 207.3 of the first anti-roll device 207. The torsion shaft 207.3 is, on both vehicle longitudinal sides 201.2 and 201.3, rotatably mounted in a bearing block 202.1 which is rigidly connected to the first undercarriage 204. On one vehicle longitudinal side 201.2, the lever 207.2 is pivotably articulated to the body 202. On the other vehicle longitudinal side 201.3, the lever 207.2 is rotatably mounted at a first articulation point 207.4 in a first free end of a first lever arm 209.1 of a coupling device 209, the operation of which will be described in greater detail hereinafter.

Similarly, the second anti-roll device 208 comprises on each side of the second undercarriage 205, parallel to each body spring device, a rod 208.1 which is pivotably articulated, on the one hand, to a lever 208.2 of the second anti-roll device 208. The two levers 208.2 are non-rotationally located on a torsion shaft 208.3 of the second anti-roll device 208. The torsion shaft 208.3 is, on both vehicle longitudinal sides 201.2 and 201.3, rotatably mounted in a bearing block 202.2 which is rigidly connected to the second undercarriage 205. On one vehicle longitudinal side 201.2, the lever 208.2 is pivotably articulated to the body 202. On the other vehicle longitudinal side 201.3, the lever 207.2 is rotatably mounted at a second articulation point 208.4 in a first free end of a second lever arm 209.4 of the coupling device 209. The first lever arm 209.1 and the second lever arm 209.4 are mechanically connected via a coupling rod 209.5, so the first anti-roll device 207 is mechanically coupled to the second anti-roll device 208 via the coupling device 209.

The first lever arm 209.1, which is configured as a short angle lever, is articulated, in proximity to the first anti-roll device 207, to the body 202 so as to be able to pivot about a first pivot point 209.2 having a first pivot axis 209.3. The first pivot axis 209.3 is located in the region of the kink in the first lever arm 209.1 and is stationarily connected to the body 202.

The first articulation point 207.4 of the first anti-roll device 207 is located at the first free end of the first lever arm 209.1, whereas the coupling rod 209.5 is articulated to the second free end of the first lever arm 209.1.

The second lever arm 209.4, which is also configured as a short angle lever, is articulated, in proximity to the second anti-roll device 208, to the body 202 so as to be able to pivot about a second pivot point 209.6 having a second pivot axis 209.7. The second pivot axis 209.7 is located in the region of the kink in the second lever arm 209.4 and is stationarily connected to the body 202.

The second articulation point 208.4 of the second anti-roll device 208 is located at the first free end of the second lever arm 209.4, whereas the coupling rod 209.5 is articulated to the second free end of the second lever arm 209.4.

The first articulation point 207.4 and the second articulation point 208.4 form, again, bearing points of the respective anti-roll device 207 or 208 with respect to the first vehicle component 202 in the sense of the present invention, i.e. a bearing point of the anti-roll device 207 or 208 that is stationary on non-actuation or fixing of the coupling device 209 and on actuation of the anti-roll device 207 or 208 with respect to the first vehicle component, i.e. in this case the body 202.

The first lever arm 209.1 and the second lever arm 209.4 comprise identical dimensions and are arranged symmetrically to the transverse center plane of the body 202. The coupling rod 209.5 runs in this case continuously on one side of the straight line connecting the pivot points 209.2 and 209.6, so a counterforce-free deflection of the first free end of the first lever arm 209.1 generates an opposing deflection of the first free end of the second lever arm 209.4 and vice versa.

Owing to the position of the first articulation point 207.4 at the first free end of the first lever arm 209.1 and the position of the second articulation point 208.4 at the first free end of the second lever arm 209.4, the coupling device 209, like the coupling device 109 from FIG. 2, causes opposing deflections of the first articulation point 207.4 and the second articulation point 208.4 of each anti-roll device 207 or 208. The amount of the deflections is in this case identical, whereas the directions are opposite in each case.

The mode of operation of the coupling device 209 and of the first anti-roll device 207 and second anti-roll device 208 which are coupled via said coupling device will be described hereinafter.

When traveling in an undeformed track bend, the body 202 experiences, as a result of the centrifugal force acting on its center of gravity which is located above the undercarriage, a rolling moment about a roll axis parallel to the vehicle longitudinal axis 201.1. This rolling moment results in differingly marked resilient yielding of the secondary suspension. If, for example, the vehicle longitudinal side 201.3 is located on the outside of the bend, the part of the body suspension devices yields more markedly on this side than on the other vehicle longitudinal side 201.2. In the undeformed track bend, the body spring devices yield to the same extent on the respective vehicle longitudinal side 201.2 or 201.3.

In the event of differingly marked resilient yielding of the body spring devices on the two vehicle longitudinal sides 201.3 and 201.2, the levers 207.2 of the first anti-roll device 207 also undergo differingly marked deflections on the two vehicle longitudinal sides 201.3 and 201.2. This results in resilient torsion of the torsion shaft 207.3. The same applies to the levers 208.2 of the second anti-roll device 208 on the two vehicle longitudinal sides 201.3 and 201.2. These also undergo differingly marked deflections, resulting in resilient torsion of the torsion shaft 208.3.

As, in the undeformed track bend, the forces are distributed substantially uniformly along the vehicle longitudinal axis 201.1 and the body spring devices thus yield to the same extent on each vehicle longitudinal side 201.2 or 201.3, the same vertical forces act on the first articulation point 207.4 and the second articulation point 208.4 perpendicularly to the plane of the undercarriage. As a result, the first lever 209.1 and the second lever 209.4 of the coupling device 209 remain substantially in their neutral position shown in FIG. 3. In other words, in the undeformed track bend, the two anti-roll devices 207 and 208 provide the same effect as the known anti-roll devices in which all of the articulation points of the two anti-roll devices are located in bearing blocks secured to the body, as is indicated in FIG. 3 by the broken contours 210.1 on the vehicle longitudinal side 201.3.

The described configuration of the coupling device 209 and the articulation of the two anti-roll devices 207 and 208 to the coupling device 209 have, on the other hand, the effect that a counterforce-free first displacement of the first anti-roll device 207, with a first deflection of the first articulation point 207.4 downward via the coupling device 209, causes an opposing second displacement of the second anti-roll device 208 with a second deflection, opposing the first deflection, of the second articulation point 208.4 upward.

Such displacements of the anti-roll devices 207 and 208 produce no significant torsion of the torsion shafts 207.3 and 208.3, so no significant additional forces, which would otherwise deform, in particular twist, the body 202, are introduced into the body 202 via the anti-roll devices 207 and 208.

If, in the case of the vehicle 201 from FIG. 3, the body spring devices yield differently, not as a result of rolling of the body 202 but rather as a result of deformation, for example torsion, of the section of track traveled over, i.e. as a result of differing vertical coordinates of the contact points of the wheels of the undercarriages 204, 205 on the rails (not shown in FIG. 3), the two anti-roll devices 207 and 208 can, owing to the described configuration of the coupling device 209, if appropriate fully follow the deformed shape of the track as a result of synchronous tilting of the first lever 209.1 and the second lever 209.4. This may lead, depending on the nature of the deformation of the track bed, to the described displacements of the two anti-roll devices 207 and 208 without torsion of the torsion shafts 207.3 and 208.3.

In specific cases, there is for example torsion of the track as a result of a longitudinal gradient of the rail, which is located on the right-hand vehicle longitudinal side 201.3 (in the direction of travel), when the rail located on the left-hand vehicle longitudinal side 201.2 is in the horizontal position, the two rails comprising the same track level in the center between the two undercarriages 204, 205. In this case, the contact point of the wheel which is located at the front right in the direction of travel is higher than that of the wheel pertaining to the same undercarriage on the left-hand vehicle longitudinal side 201.2. Conversely, the contact point of the wheel which is located at the rear right in the direction of travel is lower than that of the wheel pertaining to the same undercarriage on the left-hand vehicle longitudinal side 201.2. Similar states of the track bed may result when traveling in sections of differing track superelevation.

However, the vertical displacements which are transmitted via the respective rods 207.1 and 208.1 from the front and rear wheel on the right-hand vehicle longitudinal side 201.3 do not lead to torsion of the torsion shafts 207.3 and 208.3 of the two anti-roll devices 207 and 208. On the contrary, said displacements are compensated for by raising of the second articulation point 208.4 above the right-hand front wheel and lowering of the first articulation point 207.4 above the right-hand rear wheel via the synchronous tilting of the first lever 209.1 and the second lever 209.4 about its tilt axis 209.3 and 209.7 respectively.

It will be understood that in the event of a differing height of the raising or lowering of the two wheels 204.2 and 205.2, which are arranged on the same vehicle longitudinal side, the body 202 is raised or lowered, as a result of the residual force produced on the coupling device 209.2 in the central region, by half the differential amount on this vehicle longitudinal side. Reaction forces, such as occur in the bearings, which are rigidly connected to the body, of known anti-roll devices and which markedly stress the body 202, are in this case dispensed with.

The coupling device 209 thus brings about, in the region of the anti-roll devices 207 and 208, advantageous isolation of reactions to rolling motions and reactions to track deformations, in particular track torsion, in that mechanical displacements are carried out at articulation points 207.4 and 208.4 of the anti-roll devices 207 and 208. The achievement of the described compensatory effect as a result of mechanical displacements at articulation points 207.4 and 208.4 of the anti-roll devices 207 and 208 has, in addition to the simple mechanical embodiment, the advantage that the invention can be used with anti-roll devices of any desired configuration without having in any one form substantially to intervene in the configuration of the anti-roll device.

As is indicated in FIG. 3 by the contour 210.2, one or more adjusting and/or damping devices can be provided in the region of the coupling device 209 in order to generate active adjusting forces and/or to damp the motions occurring in the arrangement. The adjusting and/or damping device 210.2 can thus, for example, be used actively to generate a desired rolling motion of the body 202 by varying the length of the coupling rod 209.5.

It will be understood in this regard that adjusting and/or damping devices of this type can, in other variations of the vehicle according to the invention, also be arranged at a different location. It will also be understood that adjusting and/or damping devices of this type can be used also in all of the other exemplary embodiments described in the present document.

In order to achieve the described isolation of the reactions of the anti-roll devices 207 and 208, a single coupling device 209 has merely to be provided. Nevertheless, it will be understood that, in other variations of the invention, a corresponding coupling device can also be provided on both sides. Furthermore, it will be understood that other variations of the invention can also make provision for a coupling device in which, on displacement of the first anti-roll device on the opposing vehicle longitudinal side, displacement of the second anti-roll device in the same direction is achieved, as overall this allows merely the same compensatory motion to be achieved.

The exemplary embodiments described hereinbefore related to applications within a undercarriage or within a carriage as a first vehicle component, in which excessive torsional loads resulting from winding sections of track are intended to be avoided within the respective structure of the vehicle component. A comparable task must be performed for articulated trains, such as for example multiple-unit trams or trains, which consist of individual segments which are coupled to one another and have crossings for passengers located therebetween. This applies, in particular, when individual segments are not supported on their own undercarriages but rather are connected to their neighboring segments as what are known as "sedans" via articulated links in the floor region and are optionally further coupling elements in the roof region.

Figure 4:
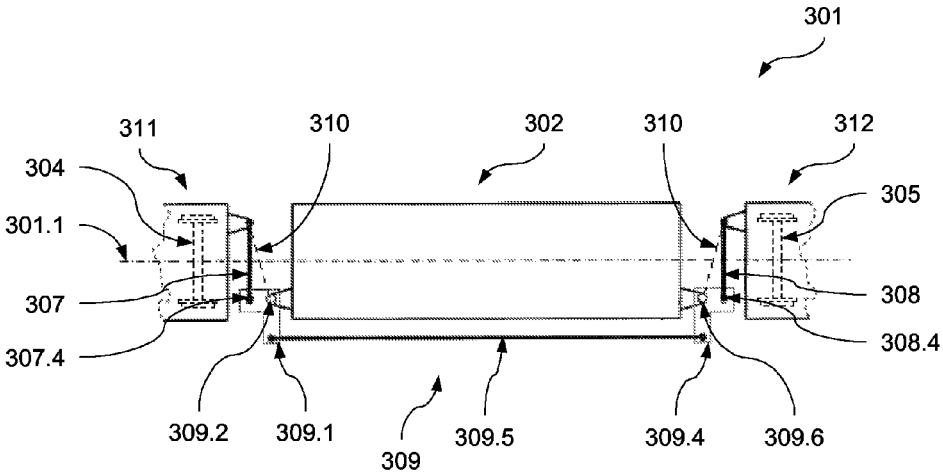
FIG. 4 depicts a schematic plan view onto a part of a further preferred embodiment of the vehicle according to the invention in the neutral position.
Figure 5:
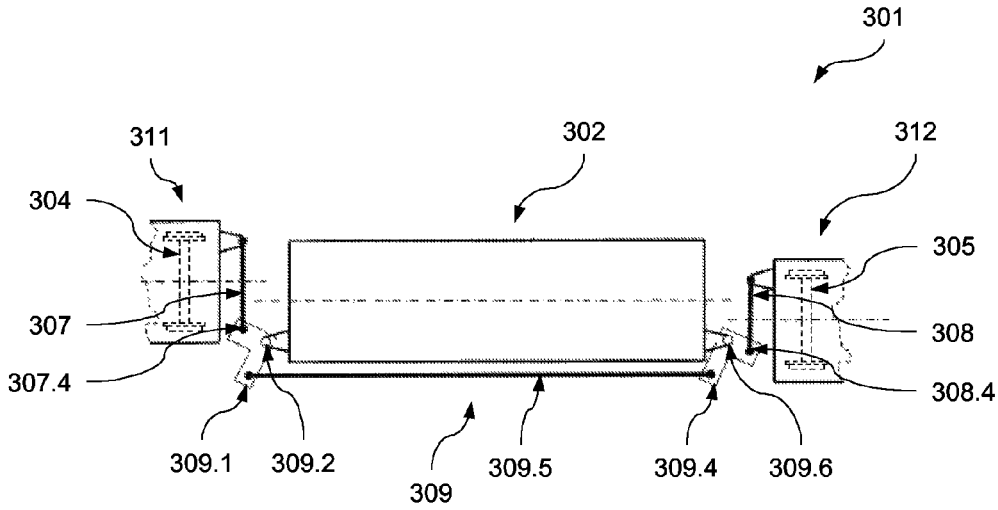
FIG. 5 depicts a schematic plan view of the part of the vehicle from FIG. 4 in the winding position.

The invention can advantageously be applied in this case too. FIGS. 4 and 5 are schematic plan views onto a part of a vehicle 301 according to the invention having a vehicle longitudinal axis 301.1. The vehicle 301 comprises a first vehicle component in the form of a wheel less first body 302 which is supported on two adjacent second vehicle components in the form of a second body 311 and a third body 312 in the manner of a sedan of this type.

The bodies 311 and 312 are each supported on running gears 304 and 305 via corresponding spring devices in the region adjoining the first body 302. The first body 302 is thus supported on the first undercarriage 304 via the second body 311 and the associated spring device and on the second undercarriage 305 via the third body 312 and the associated spring device. In other words, the bodies 302, 311 and 312 are thus vehicle segments of the multiple-unit vehicle 301.

Whereas excessive rolling differences between the bodies 302, 311 and 312 are intended to be prevented, staggered inclinations of the successive bodies 302, 311 and 312 about their respective longitudinal axis that are produced as a result of traveling on the deformed sections of track described in detail hereinbefore, in particular winding sections of track, are intended to be allowed.

Known solutions comprise, for example, rods which are arranged in the roof region between adjacent bodies in the transverse direction and connect said bodies in an articulated manner, such as are indicated by the broken contours 310 in FIG. 4. The bodies 302, 311, 312 are furthermore articulated to one another, for example, by an articulation (not shown) in the floor region. In the event of roiling motions of a body 302, 311, 312, i.e. a transverse motion in the roof region relative to the lower rolling pole, this transverse motion is transmitted to the adjacent body of the articulated train via the rigidity of the rods 310. The rods 310 thus prevent the bodies 302, 311, 312 from rolling relative to one another while at the same time allowing relative pitching of the bodies 302, 311, 312 such as can occur when traveling on track troughs or crests.

However, when traveling on winding sections of track, these rods 310 attempt to hold the adjacent bodies 302, 311, 312 all parallel to one another, in particular parallel to one another in the vertical direction, leading to the production of marked restraining forces at the articulation points of these rods 310 and thus of the structure of the bodies 302, 311, 312.

Isolation according to the invention of the dynamically conditioned and undesirable rolling motion of the relative transverse inclination, generated by traveling over a deformed section of track, for example a winding section of track, of successive segments of an articulated train is required to overcome this drawback.

In the case of the vehicle 301 illustrated schematically in FIGS. 4 and 5, this is achieved as follows, FIG. 4 being a plan view of the situation on a flat track and FIG. 5 showing the situation on a winding track:

A respective anti-roll device 307 or 308 is arranged between the respective second body 311, 312 and the first body 302. A first anti-roll device 307 is thus provided between the body 311 and the body 302, whereas a second anti-roll device 308 is provided between the body 312 and the body 302.

The first anti-roll device is configured in the form of a first push/pull rod 307 which is pivotably articulated, on the one hand, to a bracket on the second body 311. At its end facing the first body 302, the first rod 307 is rotatably mounted at a first articulation point 307.4 in a first free end of a first lever arm 309.1 of a coupling device 309, the operation of which will be described hereinafter in greater detail.

Similarly, the second anti-roll device 308 is configured in the form of a second push/pull rod 308 which is pivotably articulated, on the one hand, to a bracket on the third body 312. At its end facing the first body 302, the second rod 308 is rotatably mounted at a second articulation point 308.4 in a first free end of a second lever arm 309.4 of the coupling device 309. The first lever arm 309.1 and the second lever arm 309.4 are mechanically connected via a coupling rod 309.5, so the first anti-roll device 307 is mechanically coupled to the second anti-roll device 308 via the coupling device 309.

The first lever arm 309.1, which is configured as a short angle lever, is articulated, in proximity to the first anti-roll device 307, to the first body 302 so as to be able to pivot about a first pivot point 309.2 having a first pivot axis. The first pivot axis is located in the region of the kink in the first lever arm 309.1 and is stationarily connected to the first body 302.

The first articulation point 307.4 of the first anti-roll device 307 is located at the first free end of the first lever arm 309.1, whereas the coupling rod 309.5 is articulated to the second free end of the first lever arm 309.1.

The second lever arm 309.4, which is also configured as a short angle lever, is articulated, in proximity to the second anti-roll device 308, to the first body 302 so as to be able to pivot about a second pivot point 309.6 having a second pivot axis. The second pivot axis 309.7 is located in the region of the kink in the second lever arm 309.4 and is stationarily connected to the body 302.

The second articulation point 308.4 of the second anti-roll device 308 is located at the first free end of the second lever arm 309.4, whereas the coupling rod 309.5 is articulated to the second free end of the second lever arm 309.4.

The first articulation point 307.4 and the second articulation point 308.4 form, again, bearing points of the respective anti-roll device 307 or 308 with respect to the first vehicle component 302 in the sense of the present invention, i.e. a bearing point of the anti-roll device 307 or 308 which is stationary on non-actuation or fixing of the coupling device 309 and on actuation of the anti-roll device 307 or 308 with respect to the first vehicle component, i.e. in this case the first body 302.

The first lever arm 309.1 and the second lever arm 309.4 comprise identical dimensions and are arranged symmetrically to the transverse center plane of the first body 302. The coupling rod 309.5 runs in this case continuously on one side of the straight line connecting the pivot points 309.2 and 309.6, so a counterforce-free deflection of the first free end of the first lever arm 309.1 generates an opposing deflection of the first free end of the second lever arm 309.4 and vice versa.

Owing to the position of the first articulation point 307.4 at the first free end of the first lever arm 309.1 and the position of the second articulation point 308.4 at the first free end of the second lever arm 309.4, the coupling device 309, like the coupling device 109 from FIG. 2, causes opposing deflections of the first articulation point 307.4 and the second articulation point 308.4 of each anti-roll device 307 or 308. The amount of the deflections is in this case identical, whereas the directions are opposite in each case.

The mode of operation of the coupling device 309 and of the first anti-roll device 307 and second anti-roll device 308 which are coupled via said coupling device will be described hereinafter.

If the first body 302 experiences, for example as a result of uneven running and its high center of gravity, a pure rolling moment about a roll axis parallel to the vehicle longitudinal axis 301.1, the first articulation point 307.4 and the second articulation point 308.4 at its two body ends move with respect to the adjacent bodies 311, 312 in the same relative direction. The first free ends of the two angle levers 309.1 and 309.4 are thus symmetrically loaded, i.e. a force of substantially the same direction and the same amount is exerted thereon. Their inherent rigidity and the rigidity of the coupling rod 309.5 prevent the angle levers 309.1 and 309.4 from rotating so the arrangement, like the known rods 310, counteracts the rolling motion.

On winding of the track, the bodies 302, 311, 312, etc. in the direction of travel are successively deflected out of the vertical direction. The relative horizontal motion between the first body 302 and the preceding third body 312 and between the first body 302 and the subsequent second body 311 is then carried out in the opposite direction. This allows the two angle levers 309.1 and 309.4 to rotate in the same direction about their respective pivot point 309.2 or 309.6. The coupling rod 309.5 does not in this case experience any significant force but rather also moves almost without resistance in the vehicle longitudinal direction 301.1. As a result, the brackets on the bodies 302, 311, 312, like the bodies 302, 311, 312 themselves, are not loaded with constraining forces as in the conventional case with the rods 310.

In a mixed form of both motions, i.e. in the event of simultaneous rolling of one body when traveling over a section of deformed track, only those differential forces which correspond to the actual rolling of a single body relative to the bodies adjacent thereto are accommodated by the brackets of the anti-roll devices 307, 308, whereas the increasing oblique position, caused by the winding of the track, of the bodies 302, 311, 312 does not produce any undesirable constraining forces in the transverse direction.

Figure 6:
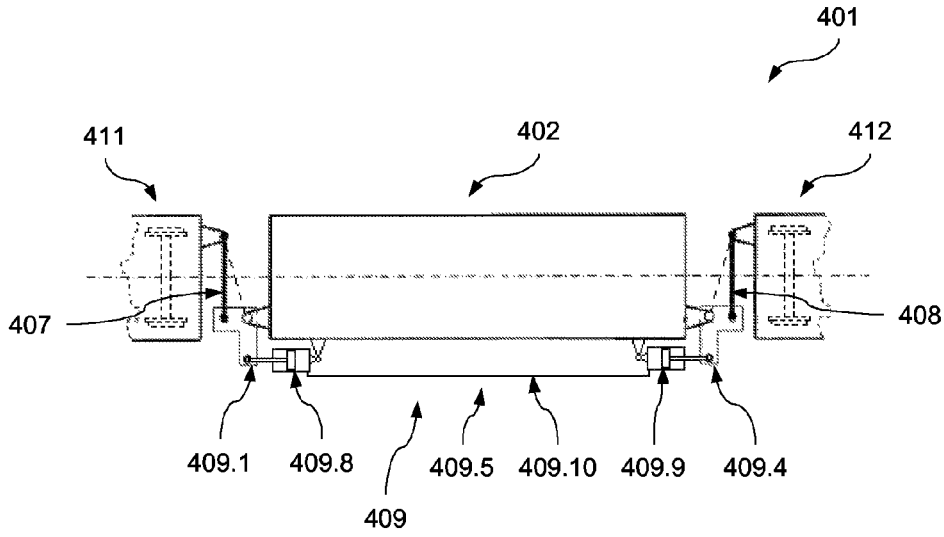
FIG. 6 depicts a schematic plan view onto a part of a further preferred embodiment of the vehicle according to the invention in the neutral position.

A further advantageous embodiment of the vehicle 401 according to the invention comprising the bodies 402, 411, 412 is shown in FIG. 6. In its basic configuration and mode of operation, the vehicle 401 corresponds in this case to the vehicle 301 from FIG. 4, so merely the differences will now be examined.

The only difference to the embodiment from FIG. 4 is the configuration of the coupling device 409 via which the two anti-roll devices 407 and 408 are linked together. Instead of the coupling rod 309.5, the coupling device 409 comprises a hydraulic coupling 409.5 having hydraulic cylinders 409.8 and 409.9, the working chambers of which are connected via a hydraulic line 409.10.

The hydraulic cylinders 409.8 and 409.9 are each pivotably articulated at one end to the first body 402. At its other end, the first hydraulic cylinder 409.8 is pivotably articulated to the first lever arm 409.1, whereas the second hydraulic cylinder 409.9 is pivotably articulated to the second lever arm 409.4.

It will be understood that, in other variations of the vehicle according to the invention, the hydraulic coupling device described hereinbefore can also be provided with an active adjusting device and/or a damping device. There may thus be provided, for example, a corresponding pump and control unit or the like which modifies the filling level of the working chambers of the hydraulic cylinders as instructed by a control device.

It will be understood that, in other variations of the vehicle according to the invention, the coupling mechanisms described hereinbefore, or else other coupling mechanisms, can be used individually or in combination in order to provide the coupling according to the invention between the anti-roll devices.

The present invention has been described hereinbefore exclusively based on examples of rail vehicles. Finally, it will furthermore be understood that the invention can also be used in conjunction with any other desired vehicles.

The invention claimed is:

1. A vehicle comprising:

a vehicle longitudinal axis, at least one first vehicle component, which is supported via at least one first spring device on at least one first wheel unit, and at least one second spring device on at least one second wheel unit, which is set apart from the first wheel unit in the direction of the vehicle longitudinal axis, and at least one first anti-roll device and a second anti-roll device, which are coupled to one another via a coupling device, the at least one first anti-roll device and the second anti-roll device are each connected to the first vehicle component and each counteract rolling motions of the first vehicle component about a roll axis parallel to the vehicle longitudinal axis, wherein the first anti-roll device is articulated to the coupling device at a first articulation point, the second anti-roll device is articulated to the coupling device at a second articulation point, and the coupling device is configured in such a way that, caused by a counterforce-free first displacement of the first anti-roll device via the first articulation point and the second articulation point, an opposing second displacement is introduced into the second anti-roll device wherein the coupling device comprises at least one first lever arm which is articulated to the first vehicle component so as to be able to pivot about a first pivot point, the first pivot point being arranged in a kinematic chain between the first anti-roll device and the second anti-roll device.

2. The vehicle according to claim 1, wherein the first anti-roll device is articulated to the coupling device at a first articulation point, the second anti-roll device is articulated to the coupling device at a second articulation point, and the coupling device is configured in such a way that a counterforce-free first displacement of the first articulation point brings about an opposing second displacement of the second articulation point.

3. The vehicle according to claim 1, wherein the first displacement and the second displacement comprise substantially the same amount but in differing directions.

4. The vehicle according to claim 1, wherein the first articulation point is a bearing point of the first anti-roll device with respect to the first vehicle component, and the second articulation point is a bearing point of the second anti-roll device with respect to the first vehicle component.

5. The vehicle according to claim 1, wherein the coupling device connects parts of the first anti-roll device and the second anti-roll device that are located on the same side of the vehicle longitudinal axis.

6. The vehicle according to claim 1, wherein the coupling device connects components of the first anti-roll device and the second anti-roll device that have the same function or position within the respective anti-roll device.

7. The vehicle according to claim 1, wherein the first lever arm comprises a free first end and a free second end, the first end being connected directly to the first anti-roll device, and the second end being connected indirectly to the second anti-roll device.

8. The vehicle according to claim 1, wherein the coupling device comprises at least one second lever arm which is articulated to the first vehicle component so as to be able to pivot about a second pivot point, the second pivot point being arranged in the kinematic chain between the first anti-roll device and the second anti-roll device, and the second lever arm being connected to the first lever arm via at least one coupling element.

9. The vehicle according to claim 1, wherein at least one of the anti-roll devices comprises a torsion element connected to the first vehicle component.

10. The vehicle according to claim 1, wherein the first vehicle component is an undercarriage frame, the first anti-roll device is connected to the first wheel unit, and the second anti-roll device is connected to the second wheel unit.

11. The vehicle according to claim 1, wherein the first vehicle component is a body, the first anti-roll device is connected to the first wheel unit, and the second anti-roll device is connected to the second wheel unit.

12. The vehicle according to claim 1, wherein the first vehicle component is a first body having a first body end and a second body end;

a second body, which is adjacent to the first body end, and a third body, which is adjacent to the second body end, are provided, the first anti-roll device is connected to the second body; and the second anti-roll device is connected to the third body.

13. The vehicle according to claim 12, wherein the first body is configured in the manner of a wheelless sedan, said first body being fastened to the second body and the third body.

14. The vehicle according to claim 1, wherein at least one of the wheel units comprises a set of wheels.

15. The vehicle according to claim 1, wherein the coupling device comprises a damping device.

16. The vehicle according to claim 1, wherein the coupling device comprises an adjusting device.

17. A vehicle comprising:

a vehicle longitudinal axis, at least one first vehicle component, which is supported via at least one first spring device on at least one first wheel unit, and at least one second spring device on at least one second wheel unit, which is set apart from the first wheel unit in the direction of the vehicle longitudinal axis, and at least one first anti-roll device and a second anti-roll device, which are coupled to one another via a coupling device, the at least one first anti-roll device and the second anti-roll device are each connected to the first vehicle component and each counteract rolling motions of the first vehicle component about a roll axis parallel to the vehicle longitudinal axis, wherein the first anti-roll device is articulated to the coupling device at a first articulation point, the second anti-roll device is articulated to the coupling device at a second articulation point, and the coupling device is configured in such a way that, caused by a counterforce-free first displacement of the first anti-roll device via the first articulation point and the second articulation point, an opposing second displacement is introduced into the second anti-roll device, wherein the coupling device comprises at least one first working cylinder, which is connected to the first anti-roll device, at least one second working cylinder, which is connected to the second anti-roll device, and at least one connecting line, which connects the first working cylinder and the second working cylinder, for a working medium.

* * * * *